United States Patent [19]

Stanton

[11] 4,287,628

[45] Sep. 8, 1981

[54] APPARATUS FOR STIFFENING SHOE INSOLES

[75] Inventor: Leo F. Stanton, Newburyport, Mass.

[73] Assignee: Bush Universal, Inc., Woburn, Mass.

[21] Appl. No.: 968,830

[22] Filed: Dec. 12, 1978

[51] Int. Cl.[3] ..... A43D 31/00; A43B 13/42

[52] U.S. Cl. ..... 12/40.5; 12/146 S; 36/76 C

[58] Field of Search ..... 12/146 R, 146 S, 146 D, 12/40.5; 36/76 R, 76 C, 76 H, 77, 98

[56] References Cited

U.S. PATENT DOCUMENTS

| | | | |
|---|---|---|---|
| 2,269,562 | 1/1942 | Stritter | 36/76 C |
| 2,294,982 | 9/1942 | Hathaway | 36/76 R |
| 2,832,976 | 5/1958 | Huprich | 36/76 R |
| 4,081,917 | 4/1978 | Bradley et al. | 36/76 R |
| 4,133,117 | 1/1979 | Bradley . | |

*Primary Examiner*—Patrick D. Lawson

*Attorney, Agent, or Firm*—Wolf, Greenfield & Sacks

[57] ABSTRACT

A method and apparatus for forming a shoe stiffener directly on a selected surface of a shoe assembly (such as a shoe shank on the bottom of an insole) from a strip of initially flexible, uncured thermosetting material encased in a sleeve. The apparatus supports a shoe assembly, bottom up, to expose the insole bottom to a radiant heater. Means are provided for automatically locating a strip of the shank material on the insole bottom and for raising the shoe assembly, together with the insole strip, into engagement with a means for urging the shank strip against and into conformity with the contour of the insole bottom. A radiant heater then is operated to activate the shank strip. The ball and heel ends of the shank strip are pressed firmly toward the insole by heat absorbing presser pads which cause the ends of the shank strip to be tapered and to promote secure bonding of the ends of the shank strip to the insole bottom.

12 Claims, 8 Drawing Figures

APPARATUS FOR STIFFENING SHOE INSOLES

BACKGROUND OF THE INVENTION

This invention relates to improvements in methods and apparatus for forming a shoe shank on the bottom of a shoe insole to stiffen the shank region which extends from the heel breast to the ball region. More particularly, the present invention is related to improvements in the method and apparatus described in my copending application Ser. No. 838,670 filed Oct. 3, 1977 and assigned to the assignee of this application. In general, the machine described in said application locates a flexible strip of activatable resinous material on the bottom of an insole and then cures the material directly in situ on the shoe bottom. The strip conforms to the contour of the shoe bottom and forms a rigid shank stiffener which adheres integrally to the insole bottom.

In brief, the apparatus described in my aforementioned prior application includes a shoe jack which supports a shoe assembly, bottom up, so that the insole of the shoe assembly may face a radiant energy source, such as a radiant heater, which is mounted above the shoe jack. Means are provided to locate a shank strip on the bottom of the shoe assembly, and a strip retaining means, in the form of a plurality of fingerlike members, is employed to hold the flexible strip against the insole bottom by engaging the longitudinally extending lateral margins of the shank strip. The radiant heater is activated while the shank strip is held by the strip retaining means to cause the shank strip material to cure in situ and form a shank stiffener directly on the bottom of the shoe insole. The resulting shank may, in some instances, terminate rather abruptly at its ball and heel ends which, in some instances, may be undesirable. It is among the general objects of the present invention to provide improvements to the machine and technique described in my prior application by which the ball and heel ends of the shank strip may taper and merge more smoothly with the ball and heel regions of the insole.

SUMMARY OF THE INVENTION

In brief, the present invention relates to the inclusion of ball and heel pressure mechanisms which bear against the ball and heel ends of the shank strip while the strip is being held against the insole bottom by the strip retaining fingers. The ball and heel presser pads are arranged to overlie the ball and heel ends of the shank strip and press the ends of the strip firmly toward the insole bottom. The flexible, deformable nature of the strip enables it to conform, at its ends, to a somewhat of a feathered, tapering configuration under the influence of the ball and heel pads. In addition, some of the resinous material is urged out of the ball and heel ends of the shank strip into direct contact with the insole bottom and also into direct contact with the ball and heel pads. The pads, as well as the strip retaining means, are maintained in this position during operation of the radiant heater. In addition to activating the exposed portion of the shank strip, the heater also heats the pads which conductively heat the ball and heel ends of the shank strip as well as the quantity of fluent resin which was squeezed out of the ends of the shank strip. This assures full and complete curing at the ends of the shank strip and a very strong, direct adhesive bond to the insole bottom, with the ends of the shank strip being tapered so that they will not strike through the insole when the shoe is worn.

It is among the general objects of the invention to provide an improved apparatus and method for applying to a surface of a shoe assembly (such as the shank region of the insole), an initially flexible and deformable strip of material formed from a curable resin.

A further object of the invention is to provide a method and apparatus of the type described which provides enhanced bonding of a shank strip, particularly at its ends, to an insole bottom.

Another object of the invention is to provide a method and apparatus for feathering and tapering the heel and ball ends of a shank stiffener which is formed in situ on the shoe bottom.

DESCRIPTION OF THE DRAWINGS

The foregoing and other objects and advantages of the invention will be appreciated more fully from the following further description thereof, with reference to the accompanying drawings wherein.

DESCRIPTION OF THE PREFERRED EMBODIMENT

Figure 1:
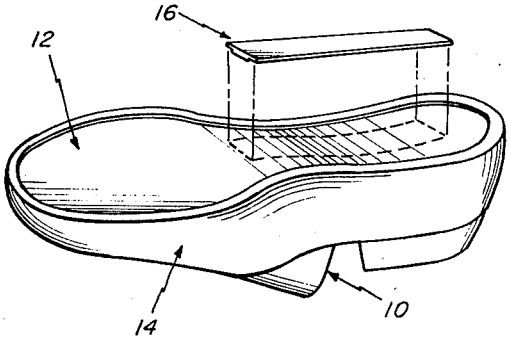
FIG. 1 shows a shoe assembly bottom-up, illustrating the manner in which the shank strip is to be located on the shoe bottom.

The invention is concerned with improvements in the location and curing of an elongate strip of material in situ on the bottom of a partially formed shoe assembly. As shown in FIG. 1, the shoe assembly includes a last 10 having an insole 12 on its bottom and an upper 14 mounted on the last. The marginal portions of the upper 14 will already have been lasted to corresponding marginal portions of the insole 12.

Figure 2:
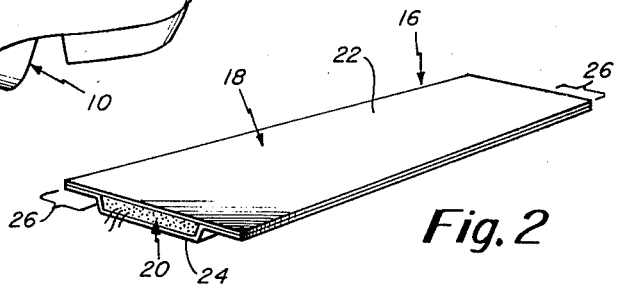
FIG. 2 is an illustration of a shank strip as may be used in accordance with the present invention.

The shank strip 16 illustrated in FIG. 2, may comprise an elongate sleeve 18 of flexible material which contains a matrix of a thermosetting resin 20 and a plurality of fiberglass strands embedded in the resin. The resin 20 is activatable by a selected external stimulus such as heat. Sleeve 18 may be formed from a pair of strips, including an upper strip 22 and a lower strip 24, which are sealed to each other along their longitudinal size to define a pair of longitudinally extending margins 26. The sleeve is formed from a material which can transmit the external activating stimulus to the resinous matrix. For example, in the embodiment described, the activating stimulus is heat in the form of infrared energy, and the sleeve is formed from a substantially transparent plastic material which will transmit infrared radiation therethrough to the matrix 20.

The shank strip 16 typically will be cut from a long supply "rope" thereof and is described in detail in U.S. Pat. No. 4,081,917 issued Apr. 4, 1978 and U.S. Pat. No. 4,133,117 issued Jan. 9, 1979. In general, the shank strip is flexible and is cut to a length so that it may be placed on the insole bottom as suggested in FIG. 1, in which the shank strip will extend from the heel breast region of the shoe to approximately the ball portion.

In the following description of the machine and its mode of operation, it should be understood that the machine may be substantially the same as described in my application Ser. No. 838,670, except for the modifications and improvements described herein. Therefore, in the interest of brevity and for clarity of description, the operation of the basic machine is abbreviated in this application, and the drawings are highly diagrammatic, sufficiently only to illustrate the general mode of operation of the basic machine. For a fuller and more detailed description of the basic machine and its mode of operation, reference is made to my application Ser. No. 838,670 as well as my prior U.S. Pat. No. 4,122,573, which are incorporated by reference herein.

Figure 5:
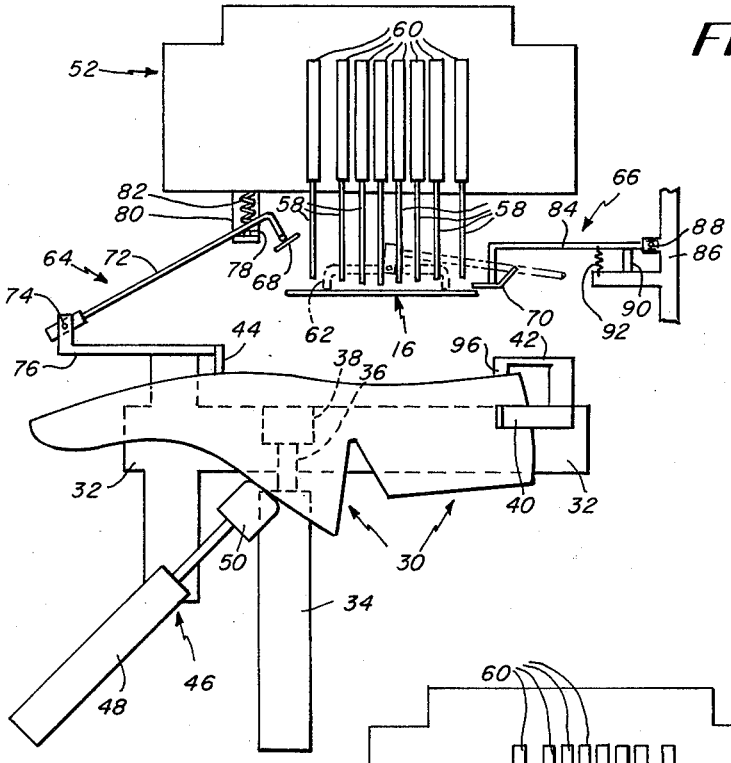
FIG. 5 is a diagrammatic illustration of the machine loaded with a shoe assembly and with the shank strip suspended in place but before the shoe assembly is raised.
Figure 6:
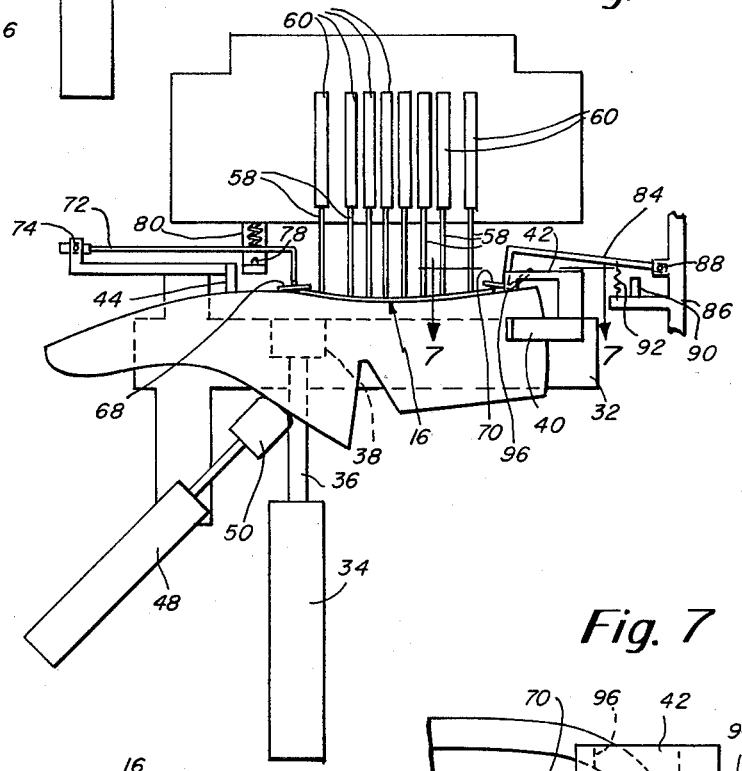
FIG. 6 is a diagrammatic illustration similar to FIG. 5 with the shoe in its raised position and in readiness for activation.

FIG. 5 illustrates, diagrammatically, the primary elements of the machine in a configuration in which the shoe assembly is clamped in the shoe jack, the shank strip is positioned above the shoe and with the machine in readiness to raise the shoe toward the activating position shown in FIG. 6. As illustrated in FIGS. 5 and 6, the primary elements of the machine include a shoe jack assembly 30 which is mounted to the frame of the machine for movement between a lowered, shoe-receptive position (FIG. 5) and a raised, activating position (FIG. 6). The shoe jack assembly 30 includes a main support bar 32 which is movable vertically by a cylinder 34 which is secured to the frame. The piston rod 36 of cylinder 34 is secured to the main support bar 32, as by a connecting bracket 38. The main support bar 32 carries the various shoe clamping elements including a V-shaped heel locater 40, heel seat fingers 42, a ball engaging member 44 and a cone clamp 46. The cone clamp may include a cylinder 48 having a clamping pad 50 secured to the piston rod of the cylinder 48. The cylinder 48 may be operated to retract the clamping pad 50 to enable the device to be loaded with a shoe assembly, and after the device is loaded, the cylinder 48 is operated to extend the clamp pad 50 into engagement with the cone of the shoe assembly as is shown in FIGS. 5 and 6. The shoe assembly is loaded and clamped in the jack assembly 30 while the jack assembly 30 is in its lowered position (FIG. 5).

A radiant energy source, such as an infrared heater, indicated generally at 52, also is secured to the frame in a manner described in detail in my aforementined application Ser. No. 838,670. The heater 52 preferably is in the form of an elongate infrared heating element 54 (see FIG. 4) within a reflector 56 which will direct the infrared radiation downwardly toward a shoe assembly (in the manner as suggested in FIG. 4) which is supported bottom-up in the machine. Radiant heater 52 and its reflector 56 are selected and arranged to direct the radiant energy downwardly toward the shoe bottom when the shoe is supported within the machine as shown. As described more fully in my prior application, the heater is focused so that its focal point F is somewhat below the bottom of the shoe assembly thereby causing the radiation from the heater to impinge on the shoe bottom in an elongate strip pattern which will substantially coincide with and include the resin-containing portion of the shank strip 16.

The machine also includes a pair of generally paralleling strip engaging means in the form of a pair of rows of fingers 58, each row or group having a plurality of fingers 58. The fingers are arranged to engage the opposite longitudinally extending margins 26 of the shank strip when the shoe assembly and strip 16 are raised toward the heater 52 to an activating position. The lower, strip engaging ends of the fingers 58 are disposed below the radiant heater 52 but well above the location of the shoe assembly when the shoe assembly is initially clamped in the shoe jack assembly 30 (FIG. 5). As described more fully in my aforementioned application Ser. No. 838,670, the fingers 58 are resiliently yieldable in an upward direction when the shoe assembly is urged upwardly toward and against the lower ends of the fingers 58. To this end, the fingers are slideably mounted, by their upper ends, in finger guides 60 which may include internal spring means biasing the fingers 58 downwardly.

Figure 3:
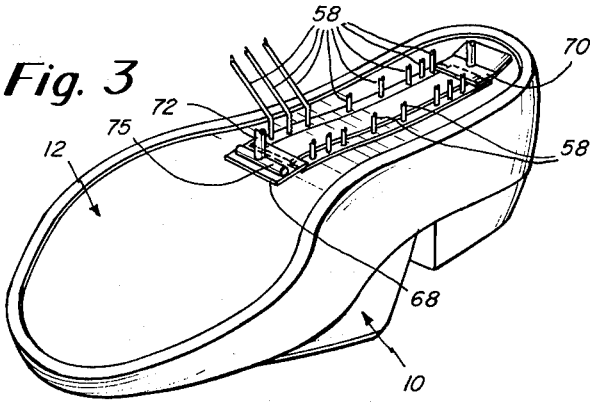
FIG. 3 is an illustration of the bottom of the shoe assembly, suggesting the manner in which the resilient fingers engage the marginal portions of the shank strip with the ball and heel pads in engagement with the ball and heel ends of the shank strip.
Figure 4:
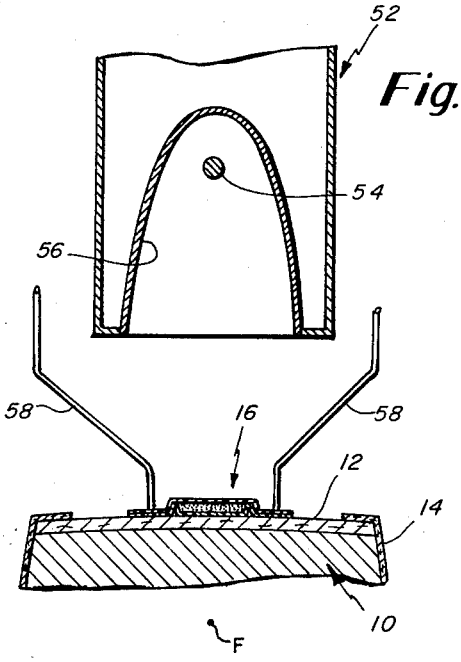
FIG. 4 is a somewhat diagrammatic sectional cross sectional illustration, seen along the longitudinal direction of the supported shoe, suggesting the relationship between the radiant heater, the shoe assembly and the resilient fingers.

The machine also includes means to locate a shank strip 16 in somewhat of a suspended position below the lower ends of the fingers 58 and above the bottom of the insole of the shoe assembly, as indicated in FIG. 5. As described in my application Ser. No. 838,670, the shank strip 16 is positioned by a strip transfer mechanism which includes a transfer head illustrated in phantom at 62 in FIG. 5. Transfer head 62 has suction pads which are adapted to hold a shank strip 16 until the vacuum applied to the suction pads is broken. The transfer head 62 is movable from a remote position, at which the head 62 is loaded with a shank strip 16, and the operative position illustrated in phantom in FIG. 5 in which the head suspends the shank strip 16 below the fingers 58 and above the bottom of the clamped, but unraised shoe assembly. With the shank strip 16 so suspended, the cylinder 34 of the shoe jack assembly 30 is operated to raise the entire shoe assembly to cause the insole 12 to engage the suspended shanks trip 16. The cylinder 34 continues to raise the shoe assembly and shank strip in unison into engagement with the fingers 58, the transfer head 62 being constructed to have some freedom of vertical movement so that it may move upwardly together with the shoe assembly and strip, until the shoe assembly has been raised to the activating position shown in FIG. 6. The strip transfer mechanism then is operated to withdraw the transfer head 62 (which is omitted from FIG. 6 for clarity). FIGS. 3 and 4 illustrate the relationship of the fingers 58, shank strip 16 and shoe insole, in a manner in which the shank strip is held in place in conformity with the contour of the insole bottom.

In accordance with the present invention, means also are provided to engage and press the ball and heel ends of the shank strip 16 toward and against the bottom of the insole. To this end, the machine includes a ball pressing device 64 and a heel pressing device 66 which are illustrated diagrammatically in FIGS. 5 and 6. The ball press 64 and heel press 66 include plate-like presser pads 68, 70 which are intended to overlie their associated ends of the shank strip 16 and resiliently press and flatten the ends of the strip 16 as suggested in FIGS. 3 and 8. The pads 68, 70 are dimensioned so that they will overlap the full width of the shank strip. The pads 68, 70 are located so that they also will overlie the region of the insole which surrounds the ball and heel end of the strip 16. The mechanism 64 is constructed to be movable between remote and operative positions so that they will not interfere with the operation of the strip transfer head 62 when the head 62 suspends the strip 16 between the fingers 58 and the shoe assembly.

Figure 7:
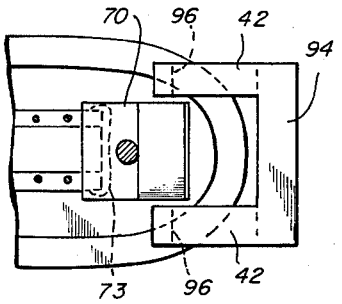
FIG. 7 is a diagrammatic plan view of the heel region of the shoe assembly as seen along the lines 7—7 of FIg. 6.
Figure 8:
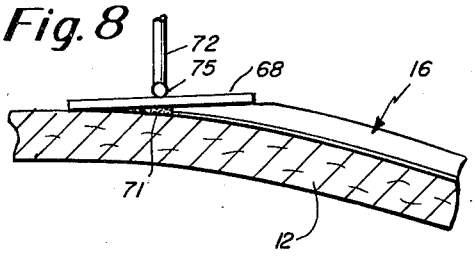
FIG. 8 is an enlarged illustration of the manner in which one of the presser pads engages and tapers an end of the shank strip.

When the shoe assembly has been raised to its activating position (FIG. 6) in which the fingers 58 press the margins 26 of the sleeve 16 against the insole, the ball pad 68 and heel pad 70 will bear firmly against the ball and heel ends, respectively, of the shank strip. The shank strip will have been cut from an elongate supply length and its ends will be open. The pressure applied by the pads 68, 70 will cause a small quantity of the resin in the sleeve to be squeezed out of the open ends of the sleeve, into direct contact with the insole and also into direct contact with the underside of its associated pads 68, 70. FIGS. 7 and 8 illustrate some of the resin 71, 73 which has been squeezed out of the heel and ball ends of the strip 16, respectively. The pads 68, 70 are formed from a material and are of a suitable thickness and dimensions so that when exposed to the infrared energy from the radiant heater 52, the pads 68, 70 will become heated sufficiently to be able to activate the underlying resin in direct heat conduction. I have found that stainless steel having a thickness of the order of 0.030 inches have been satisfactory. The upper surface of the pads 68, 70 which face the radiant heater 52, may be darkened to provide the degree of infrared absorption desired.

The pads 68, 70 thus perform a number of functions. They serve to further hold the strip 16 down against the insole bottom in substantial intimate contact with the insole 12. They cause a small quantity of the resin to squeeze out from the end and/or open edge regions of the shank strip sleeve into direct contact with the insole bottom and they effect a rapid and complete cure of the ends of the shank strip by direct contact with the ends of the strip and the resin exuded from the strip. In addition, the pressure applied by the pads 68, 70 tends to flattent and taper the ends of the shank strip so that the resulting shank stiffener will be tapered and feathered at its ends, tending to merge smoothly into the surface of the insole bottom. As mentioned, this is desirable in that it presents a better feel for the wearer of the shoe and avoids any tendency for an end of the shank to strike through the insole.

FIGS. 5 and 6 illustrate diagrammatically, but one technique for mounting the presser pads 68, 70 in the machine. As shown, the ball press mechanism 64 may include a ball pad carrier arm 72 to which the ball pad 68 is mounted (for example, by welding to a cross member 75). The arm 72 may be pivoted at its other end, at a pivot 74, to a bracket 76 which is secured to and movable with the main support bar 32 of the shoe jack assembly 30. The arm 72 may be supported between its ends by an arrangement which includes an arm rest member 78. In the diagrammatic embodiment illustrated, the arm rest 78 supports the arm in a manner which enables the arm 72 to pivot on the arm rest 78 as well as to have some longitudinal movement with respect to the arm rest 78. The arm rest 78 may be secured to a bracket 80 which is fixed to the frame of the machine or some other stationary member of the machine such as the housing for the radiant heater 52. The arm 72 is biased downwardly by a suitable biasing means, such as a compression spring 82 which may be suitably mounted to the bracket 80 and in operative engagement with the arm 72 to bias the arm 72 downwardly. As shown, the arrangement of the arm rest 78, bracket, 80, spring 82, and arm pivot 74, are such that when the shoe jack is in its lowered position, the ball pad 68 will be in a raised, out-of-the-way location and will not interfere with the insertion of a shoe assembly into the shoe jack 30 or positioning of the strip 16 by the transfer head 62. When the shoe jack is raised, the upward movement of the pivot 74 causes the arm 72 to rotate clockwise as seen in FIG. 5, to swing the ball presser pad 68 downwardly while the shoe assembly is being raised, until the pad 68 engages the bottom of the shoe assembly. The ball press arrangement 64 is constructed in relation to the other elements of the machine so that it will engage the shoe assembly in a manner which overlaps the ball end of the shank strip to press the ball end of the shank strip into a tapered, feathered configuration, and to cause some of the resin material to be urged out of the ball end of the sleeve, as suggested in enlarged FIG. 8. During the final portion of the upward movement of the shoe assembly, the carrier arm 72 is raised upwardly and away from the arm rest member 78, against the force of the biasing means 82 which presses the ball presser pad 68 firmly against the ball end of the shank strip 16.

The heel press arrangement 66 similarly includes a heel pad carrier arm 82 which is pivoted to a stationary portion 86 of the machine, such as a frame portion. The heel carrier arm 84 is pivoted at a pivot 88 and its other end carries the heel presser pad 70. A stop member 90 may be mounted to the stationary portion 86 of the frame to limit the downward position of the carrier arm 84. A biasing means, such as a tension spring 92, may be connected between the arm 84 and frame of the machine to bias the arm 84 downwardly against the lower limit of the stop 90. The heel pad 70 is located in the machine so that, when the shoe assembly is raised to its activating position, the heel pad 70 will engage and overlie the heel end of the shank strip as suggested in FIGS. 6 and 7. The heel pad 70 is constructed and arranged so that it will press and taper the heel end of the shank strip in a manner similar to that described in connection with the ball pressing member. Stop 90 is arranged so that the heel press 70 will engage the shank strip before the shoe assembly has been raised fully to its activating position. As the shoe assembly is thereafter raised to its uppermost position, the heel carrier arm 84 swings about the pivot 88 and the biasing force of the spring 92 urges the arm 84 and pad 70 firmly against the heel seat region of the shoe assembly. It may be noted that in the device described in my aforementioned application Ser. No. 838,670, the desired location of the heel pad 70 is such that it will not interfere with operation of the shank strip transfer head 62, and, therefore, there is no need to provide an arrangement to move the heel presser pad mechanism 66 out of the way for loading purposes.

It may be noted that the clamping arrangement for the heel end of the shoe assembly is modified somewhat from that disclosed in my prior application Ser. No. 838,670. As shown in FIG. 7, the present embodiment of the invention employs a U-shaped heel seat stop, indicated at 94. The heel seat stop 94 includes the pair of toewardly extending fingers 42 which are transversely spaced to provide space for the heel pad 70 to be accommodated at the middle portion of the heel seat region of the shoe assembly. The outer ends of the fingers 42 terminate in downwardly extending portions 96 (see FIG. 5), which bear against the bottom of the shoe assembly at the heel end and locate the heel seat of the shoe assembly.

When the shoe assembly has been raised to its activating configuration illustrated in FIG. 6, the radiant heater 52 is operated to activate the entire shank strip. The ends of the shank strip, which lie beneath the presser pads 68, 70 also are activated by direct contact with the pads which, in turn, are heated by the radiant energy from the heater 52. This assures that the entire shank strip will be cured, from its ball end to its heel end, and also assures a firm intimate bond fully along the length of the shank strip and, particularly at its ends, while providing a feathered configuration for each end of the resulting shank stiffener.

It should be understood that the foregoing description of the invention is intended merely to be illustrative thereof and that the description has been diagrammatic, but in a manner which will be understood by those of ordinary skill in the art. Other embodiments of the invention may be apparent to those skilled in the art without departing from its spirit.

Having thus described the invention, what I desire to claim and secure by Letters Patent is:

1. An apparatus for applying a strip of activatable, curable material to a surface of a shoe assembly to form a stiffener in situ on the surface, the strip being flexible and deformable prior to curing thereof, said material being curable in response to radiation of a predetermined character, said apparatus comprising:

means for retaining the strip in a predetermined position on said surface of said shoe assembly and for urging the strip into engagement with the surface, said retaining means being constructed and arranged so as to expose a substantial portion of the strip thereby to enable the strip to be exposed to said radiation;

radiant energy means for generating said radiation for activating the strip while the strip is retained in said position on said surface;

presser means engageable with a selected portion of the strip for overlapping an edge portion of the strip and an adjacent region of said surface to press the edge portion of the strip into a tapered, feathered configuration while said strip is retained in said position on said surface; and said presser means being constructed and arranged so as not to interfere with the activation or curing of the material.

2. An apparatus as defined in claim 1 wherein the presser means is constructed and arranged so as to accelerate activation curing of the material at least in that region which underlies the presser means.

3. An apparatus as defined in claim 2 further comprising:

said activatable, curable material being activatable in response to heat;

said activating means comprising means for heating the strip when the strip is in said predetermined position on the surface of the shoe assembly; and said presser means being located to receive heat from the activating means and being constructed to conduct said heat to that portion of the strip which underlies the presser means.

4. An apparatus as defined in claim 3 further comprising:

said activating means comprising a radiant heater for directing radiant heat toward the strip; and said presser means being located within the field of propogation of the radiant heat from the activating means, the presser means being formed from a material and being dimensioned so as to absorb heat from the radiant heater and conduct the heat to the portion of the strip which underlies the presser means.

5. An apparatus as defined in claim 3 wherein the strip of activatable, curable material comprises a sleeve which contains a resin in fluent form, said sleeve having an opening therein to enable some of the fluent resin to flow out of the opening and onto the surface of the shoe assembly, said apparatus comprising:

means for locating the strip on the surface of the shoe assembly in a position in which the presser means will engage that portion of the sleeve which includes said opening thereby to cause a portion of the fluent resin to be urged out of the opening into direct contact with said surface of the shoe assembly and the presser means.

6. An apparatus as defined in claim 1 wherein said surface of said shoe assembly comprises the bottom of an insole and wherein the strip of material comprises an elongate strip of material extending generally from the ball region of the insole to the heel seat region of the insole, and wherein said edge portion of the strip comprises an end region of the elongate strip.

7. An apparatus as defined in claim 1 wherein the presser pads have substantially flat surfaces engageable with the strip.

8. An apparatus for applying a strip of activatable, curable material to a surface of a shoe assembly to form a stiffener in situ on said surface, the strip being flexible and deformable prior to curing thereof, and being activatable in response to the application of heat thereto, from a radiant source of heat, said apparatus comprising:

means for retaining the strip in a predetermined position on said surface of said shoe assembly and for urging the strip into engagement with the surface, said retaining means being constructed and arranged so as to expose a substantial portion of the strip thereby to enable the strip to be exposed to said radiant heat;

radiant energy means for generating said radiation for activating the strip while the strip is retained in said position on said surface;

presser means engageable with a selected portion of the strip to press the selected portion of the strip firmly into engagement with the surface of the shoe assembly;

said presser means being located to receive heat from the activating means and being constructed and arranged to conduct heat directly to that portion of the strip which underlies the presser means.

9. An apparatus for applying a strip of activatable, curable material to a bottom of an insole to form a stiffener on the insole, the strip being flexible and deformable prior to curing thereof, said material being curable in response to radiation of a predetermined character, said apparatus comprising:

a frame;

shoe support means mounted to the frame for supporting the shoe assembly;

strip retaining means supported by the frame and having strip engaging portions adapted to press a strip toward and against the insole bottom, said retaining means being constructed and arranged so as to expose the substantial portion of the strip thereby to enable the strip to be exposed to said radiations;

means mounting the shoe support means and the strip retaining means to the frame so that one may be moved relative to the other between a first, remote position and a second, operative position in which the strip retaining means may be urged against the insole of the shoe assembly supported in the shoe support means;

means for effecting said relative movement between said shoe support means and the strip retaining means to cause the strip to be urged firmly against the insole bottom;

presser means engageable with each of the ball and heel ends of the strip for pressing the ball and heel ends of the strip firmly against the bottom of the insole; and Radiant energy means for generating said radiation for activating the strip while it is maintained against the insole bottom by the strip retaining means and the presser means.

10. An apparatus as defined in claim 9 wherein said strip is activatable in response to heat, said apparatus further comprising:

said activating means comprising a radiant heater supported by the frame for radiating heat toward the strip;

said presser means being constructed and arranged to absorb heat from the activating means and to conduct heat directly to those portions of the strip which underlie the presser means.

11. An apparatus as defined in claim 9 further comprising:

bias means operatively associated with the presser means to cause the presser means to yieldably press the underlying portions of the strip toward the insole bottom.

12. An apparatus as defined in claim 11 further comprising:

means mounting at least one of the presser means for movement between a shoe assembly engaging position and a remote, idle position;

means interconnecting said at least one presser means with said means for effecting relative movement between the shoe support and the retaining means to maintain the presser means in its remote position when the shoe support means is in its first, remote position and to cause the at least one presser means to move to a shoe assembly engaging position in response to movement of the shoe support means to its second, operative position.

* * * * *